US008690420B2

(12) United States Patent
Semon

(10) Patent No.: US 8,690,420 B2
(45) Date of Patent: Apr. 8, 2014

(54) MECHANICAL WATCH MOVEMENT

(75) Inventor: Guy Semon, Neuchâtel (CH)

(73) Assignee: LVMH Swiss Manufactures SA, La Chaux-de-Fonds (CH)

( * ) Notice: Subject to any disclaimer, the term of this patent is extended or adjusted under 35 U.S.C. 154(b) by 285 days.

(21) Appl. No.: 13/053,599

(22) Filed: Mar. 22, 2011

(65) Prior Publication Data

US 2012/0243386 A1 Sep. 27, 2012

(51) Int. Cl.
*G04B 17/04* (2006.01)

(52) U.S. Cl.
USPC ..... 368/127; 368/175

(58) Field of Classification Search
USPC ..... 368/127, 129, 134, 128, 130–133, 169, 368/175
See application file for complete search history.

(56) References Cited

U.S. PATENT DOCUMENTS

| | | | | |
|---|---|---|---|---|
| 2,464,316 | A * | 3/1949 | Jeanneret | 368/124 |
| 7,905,655 | B2 * | 3/2011 | Jolidon | 368/101 |
| 8,113,707 | B2 * | 2/2012 | Jolidon | 368/101 |

FOREIGN PATENT DOCUMENTS

WO WO 03/065130 A2 8/2003

* cited by examiner

*Primary Examiner* — Sean Kayes
(74) *Attorney, Agent, or Firm* — Pearne & Gordon LLP

(57) ABSTRACT

Mechanical watch movement comprising a mechanical chronograph with a regulator organ for regulating the running of the chronograph, characterized in that the regulator organ of the chronograph is placed in an imaginary circle (A) coaxial to the movement and having a radius ($r_1$) smaller than 50% of the maximum outer radius of the movement.

10 Claims, 7 Drawing Sheets

MECHANICAL WATCH MOVEMENT

TECHNICAL FIELD

The present invention concerns a mechanical watch movement having a mechanical chronograph with a regulator organ for regulating the running of the chronograph.

STATE OF THE ART

Mechanical watches usually comprise a regulator organ composed of an flywheel, called balance, on the axis of which a hairspring, called spiral, is fastened. The balance wheel and hairspring combination oscillates around its position of equilibrium at a frequency that depends notably on the rigidity of the spiral and on the moment of inertia of the balance.

Known balances are constituted of an annular mass, the felloe, held by one or two arms. Taking into account the available energy, balances have a great moment of inertia for a low mass; this means that their diameter is as large as the available space allows and that the mass is concentrated at the periphery in the felloe. This moment of inertia can furthermore be modified to set the watch, either manually by means of screws, or automatically in the case of bi-metal balances that deform with temperature. However, involuntary deformations of the balance, for example due to dilatations, affect negatively the running of the watch.

In other words, the balance serves as flywheel and compensates for the lack of energy stored in the spiral during deformation. However, the balance causes many disturbances, due to inaccuracies of its inertia during manufacture, to dilatations, etc.

A given balance coupled with a given spiral oscillates at a determined frequency. The number of beats per time unit determines the time resolution of the regulator organ. For example, a mechanical watch displaying the seconds o f the current time must include a regulator organ performing at least 3,600 beats per hour. In practice, conventional regulator organs perform 28,800 or sometimes 36,000 beats per hour, which makes it possible to measure time with a resolution of 0.125 resp. 0.1 second.

By increasing the oscillation frequency, the time resolution is improved, which allows shorter time intervals to be measured. An improved time resolution is useful in particular for chronographs, for which a time resolution of a hundredth of a second is sometimes desired. A high oscillation frequency, however, generates considerable energy losses, notably regarding the escapement, which reduces the watch's power reserve. For this reason, the chosen oscillation frequency is usually a trade-off between the constraints imposed by the chronograph's resolution and the will to maintain a power reserve as high as possible for displaying the current time.

Conventional chronograph watches take the energy necessary for the chronograph's operation from the cinematic chain connecting the barrel to the regulator organ and to the indicators of the watch. Consequently, the running of the watch is disrupted when the chronograph is started.

Patent application WO03/065130 in the name of TAG Heuer SA and whose contents is incorporated by reference discloses a construction in which a base movement designed to display the current time is provided with a first barrel and a first regulator organ performing 28,800 beats per hour, whilst an auxiliary chronograph module is provided with a second barrel and a second regulator organ performing 360,000 beats per hour. This construction allows a chronograph to be made that is capable of measuring time with a resolution to the hundredth of a second without affecting the power reserve of the base movement used for displaying the current time. Furthermore, as the two cinematic chains are independent, starting the chronograph does not affect the accuracy of the base movement or the running of the watch. This solution has been implemented in the "Calibre 360" of TAG Heuer, thus demonstrating the technical feasibility of this solution.

Regulator organs for regulating the running of known chronographs are generally placed at the periphery of the movement, i.e. in an imaginary circle coaxial to the movement and of a diameter greater than 50% or even 70% of the maximum outer diameter of the movement. They are generally placed at 7 o'clock. In this manner, the movement's escapement comprises a pallet wheel that drives the hand at the centre, for example the seconds' hand or the tenth of a second's hand or the hundredth of a second's hand through a rather long gear chain, comprising several wheels and mobiles, which increases the energy loss.

BRIEF SUMMARY OF THE INVENTION

One aim of the present invention is to propose a mechanical watch movement including a mechanical chronograph with a regulator organ that allows the length of the gear chain between the central hand and the pallet wheel to be reduced.

According to the invention, these aims are achieved notably by means of a mechanical watch movement having the characteristics of the main claim and of a mechanical chronograph including such a movement.

The mechanical watch movement according to the invention comprises a mechanical chronograph with a regulator organ for regulating the running of the chronograph, and it is characterized in that the chronograph's regulator organ is placed in an imaginary circle coaxial to the movement and having a radius smaller than 50% of the maximum outer radius of the movement.

This solution affords notably the advantage over the prior art of reducing the length of the gear chain between the central hand and the pallet wheel.

BRIEF DESCRIPTION OF THE FIGURES

Examples of embodiments of the invention are indicated in the description illustrated by the attached figures in which.

EXAMPLES OF EMBODIMENTS OF THE INVENTION

Figure 1:
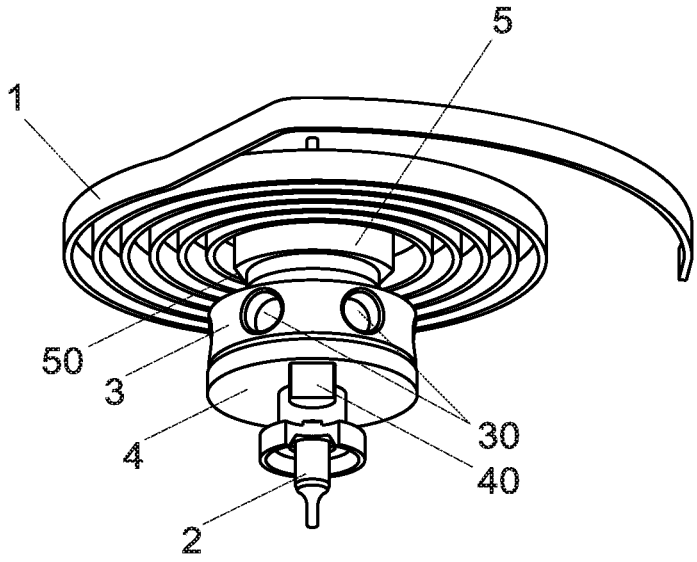
FIG. 1 illustrates a perspective view of a regulator organ that is part of the mechanical chronograph movement according to the invention.
Figure 2:
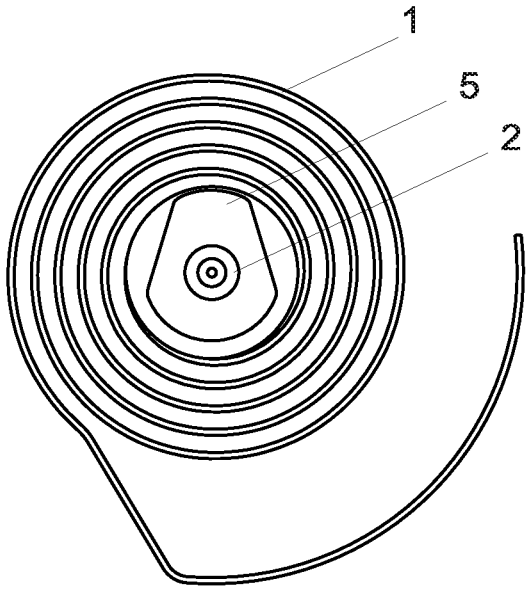
FIG. 2 illustrates a top view of a regulator organ that is part of the mechanical chronograph movement according to the invention.
Figure 3:
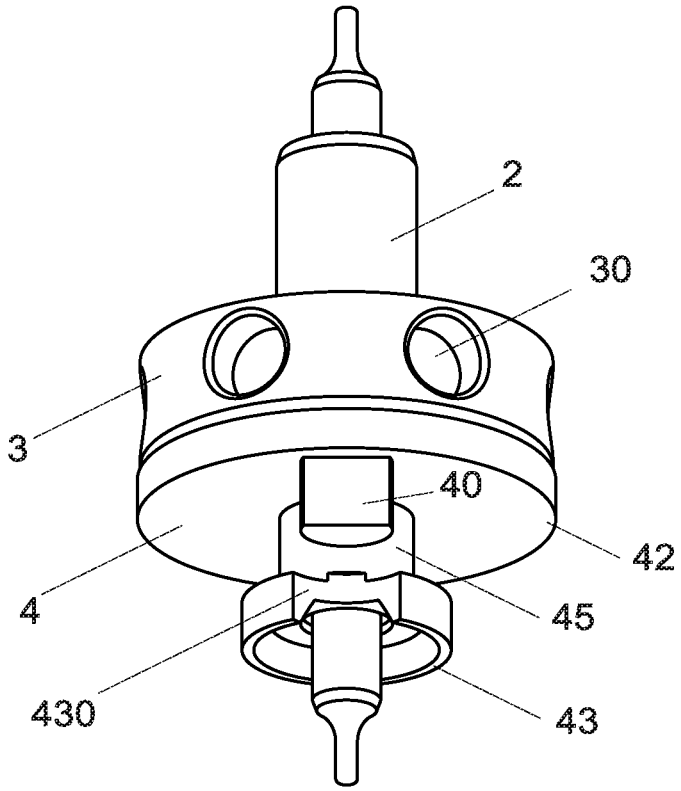
FIG. 3 illustrates a perspective view of the staff, the hub and the roller of a regulator organ that is part of the mechanical chronograph movement according to the invention.

An embodiment of the regulator organ is illustrated in FIGS. 1 and 2. This regulator organ is designed in particular to serve as regulator for the chronograph function of a mechanical chronograph; a single movement can comprise two regulator organs on the same plate, or on two distinct plates, with one of the regulator organs serving to regulate the running of the watch whilst the other regulator organ, identical or similar to that described in this application, serves to regulate the running of the chronograph function. A distinct barrel supplies the energy necessary to each regulator organ, which allows disturbances in the running of the watch to be avoided when the chronograph is started.

The power reserve of the second barrel, which indicates the duration that can still be measured with the stopwatch before the second barrel needs to be recharged, is preferably indicated on the dial by means of a power reserve indicator of the chronograph. The power reserve of the first barrel charging the first regulator organ used for displaying the current time is advantageously indicated separately on the dial by means of a power reserve indicator of the watch. Both barrels can preferably be charged simultaneously by means of a common wind-up stem engaging on both barrels and/or by means of a common oscillating mass. In another embodiment, the first barrel is wound up automatically and the second manually. In one embodiment, both barrels can be wound up separately by means of two distinct wind-up stems and/or oscillating masses. In another embodiment, one of the barrels (for example the chronograph barrel) is charged by the other barrel that is wound up manually or automatically; the available energy is then distributed between the two barrels.

The illustrated regulator comprises a spiral 1 mounted using a collet 5 on a spiral staff 2. The regulator organ lacks a balance. According to the example, the chronograph's regulator organ is dimensioned so as to oscillate at frequencies never achieved previously, preferably at a frequency of 3,600,000 beats per hour, i.e. 500 Hz.

In order to achieve these high frequencies, the regulator organ comprises notably a staff 2 designed to turn between two bearings, not represented, when the spiral 1 winds and unwinds. A roller 4 mounted on this staff bears the impulse pin 40 that works together with the horns 60, 65 and with the guard pin 61 of an pallet 6 represented in FIGS. 5 and 6, in a manner similar to the more conventional Swiss pallet escapements.

The roller 4 is advantageously made of silicon or ceramics or of another material with a lower density than that of the staff 2 in order to reduce its moment of inertia. It is advantageously made of two discs: the large roller 42 and the small roller 43, connected to one another by an hour's wheel 45. The small roller can comprise a notch 430 for the guard pin. A simple roller, with a single disc, can also be used.

The staff 2 also bears a driven or glued hub 3 that serves to offer a resting surface for the whip 72 of the launcher, described further below in relation with FIG. 4. The staff of the regulator organ is thus accelerated in a nearly instantaneous fashion when the push-button 75 is engaged so as to communicate an impulsion to the hub 3 through the blade 73, the column wheel 74 and the launcher 7. When the chronograph stops, the pressure of the whip 72 on the hub allows the hub to be blocked whilst holding the regulator organ of the chronograph and thus enables the position of the chronograph's hands to be held.

Contrary to a balance, the hub 3 lacks spokes; its mass is thus concentrated close to the center, so as to reduce its moment of inertia. The hub 3 is advantageously made of silicon or of another material with a density lower than that of the staff 2, in order to reduce its moment of inertia. In a variant embodiment, the hub is made of titanium and/or aluminum and/or of an alloy containing at least one of these materials.

Blind holes 30 in a plane perpendicular to the staff 2 allow this hub 3 to be made even lighter. Through holes or blind holes in another direction, including holes going through the hub in parallel to the staff or along any direction, can also be used to make the hub 3 lighter. It is also possible to make the hub 3 lighter by making it with a lighter core covered with a more resistant coating onto which the whip 72 of the launcher can give an impulsion without deforming the hub 3.

In the same manner, it is also possible to make the roller 4 lighter by providing through holes or blind holes or by giving it a non-circular shape, with the aim of reducing its moment of inertia.

The regulator organ lacks a balance; adjusting it is thus achieved only with the index-assembly of the spiral 1, advantageously by adjusting the length of the oscillating portion of the spiral by means of a screw perpendicular to the plate and allowing the point at which the outer extremity of the spiral is fastened onto the bottom plate or on a bridge to be adjusted. This system allows a very accurate adjustment of the spiral's length but other known types of regulating means are applicable to the spiral.

The diameter of the hub 3 is reduced as much as possible, again with the aim of reducing its moment of inertia. In a preferred embodiment, the diameter of the hub 3 is comprised between 1.5 and 10 times the maximum diameter of the staff 2, for example between 5 and 6 times the diameter of the staff 2. In the illustrated example, the outer diameter of the hub 3 is identical to the outer diameter of the roller 4. If a greater resting surface for the launcher 7 is required, it would be possible to use a hub 3 slightly greater than the roller 4, with its diameter however preferably not exceeding the double of the maximum diameter of the large roller 42.

Contrary to a regulator organ comprising a balance, which contributes a potential and cinematic energy considerably greater than that of the staff 2, the potential and kinetic energy accumulated by the hub 3 is lower than that which is accumulated by the staff 2 at each beat, being preferably negligible relative to that of the staff 2.

The hub 3 can also constitute an integral part of the staff 2. In a variant embodiment, the hub 3 and the roller 4 are integrated within a single element, for example made by profile-turning, which bears the impulse pin 40 and on which rests the launcher 7. In another embodiment, the collet is also integrated within this element. This element can advantageously made of titanium and/or aluminum and/or of an alloy containing at least one of these materials.

The collet 5 allows the inner extremity of the spiral 1 to be held on the staff 2. It is advantageously made in the form of a circular disc of which two or several segments are truncated in order to make it lighter and to reduce its moment of inertia. A notch 50 in the side of the collet 5 allows the spiral to be fastened. The maximum diameter of the collet is preferably of the same order of magnitude as the maximum diameter of the roller and of the hub. For example, the diameter of the hub 3 can be comprised between 1 and 3 times the maximum diameter of the collet 5.

The spiral 1 can be made of metal, preferably of invar, of silicon, of diamond, of corundum or of any suitable material. Advantageously, the spiral is considerably stiffer than a conventional spiral and thus exerts a return torque towards the resting position considerably greater than a classical spiral. The stiffness (or rigidity) of the spiral is given by the formula:

$$C=M/\phi$$

C=constant of the spiral's rigidity,
M=return torque of the spiral,
$\phi$=torsion angle.

A high rigidity necessary for a beat at 500 Hz can be achieved by combining at least two of the following measures:

- The number of spires is lower than in the traditional spirals, so as to reduce the length of the vibrating part. Advantageously, the spiral comprises less than 5 spires, for example 4, 5, preferably 3 spires or fewer.
- The spiral is thicker than conventional spirals: for example, its thickness is greater than 40 μm, preferably greater than 50 μm, for example 55p.m.
- It is harder than conventional spirals: for example, its height is greater than 200 μm, preferably greater than 215 μm, for example 230 μm.
- It can be made of a more rigid material, preferably not sensitive to temperature variations.
- Ribs or a rectangular section can be used in order to make it more rigid.
- A surface coating can be used in order to make it more rigid.
- The spiral's section can be non-constant along the spiral in order to make it more rigid.

The ratio $(e^3 \cdot h)/l$, with e being the thickness of the spiral, h its height and l its length, is about 30 times greater than the same ratio of a conventional spiral.

The spiral is advantageously constituted by a perfect Archimedes spiral, which is favorable to isochronism. By reason of its rigidity and its short length, it practically does not deform under the effect of gravity, so that the Philips terminal curves can be unnecessary or even disadvantageous. Its rigidity also rends it less sensitive to perturbations dues to magnetostriction. Furthermore, a rigid spring has the effect of increasing the frequency of the oscillations and to reduce their amplitude, which allows it to operate in a reduced range of oscillations favorable to isochronism. Oscillations of a reduced amplitude, in other words, afford the watch a higher accuracy. Since the spiral's oscillations are practically isochronous, using a coating, for example of silicon oxide, is no longer necessary.

The stiffness of the spiral gives it an efficient geometric stability: the spiral therefore hardly deforms in the different planes in space. Thus, this stiff spring advantageously has major static and dynamic stability relative to the conventional spirals at 3-5 Hz. The spiral's stiffness also makes it non self-starting, unlike the conventional balance-hairspring regulator organs.

The oscillation frequency of the classic balance wheel and hairspring combinations used in watchmaking can be determined with the aid of the known formula:

$$f = \frac{1}{2\Pi}\sqrt{\frac{M}{I}} \qquad 1)$$

This frequency is thus inversely proportional to the square root of the moment of inertia I of the balance.

In the state of the art, the moment of inertia I of the rotating parts of the regulator organ is determined almost exclusively by the felloe, which constitutes approximately a portion of hollow cylinder.

$$I = \frac{1}{2}m(R^2 + r^2) \qquad 2)$$

From which can be deduced:

$$f = \frac{1}{2\Pi}\sqrt{\frac{M}{\frac{1}{2}\Pi\, h\rho(R^4 - r^4)}} \qquad 3)$$

f Oscillation frequency [Hz]
M Elastic torque of the spiral [Nm]
I Moment of inertia of the balance [$kg \cdot m^2$]
R Outer diameter of the balance [m]
r Outer diameter of the balance [m]
h Thickness of the balance [m]
ρ Specific mass of the balance [$kg/m^3$]

The equations 2) and 3) however cannot be applied to the regulator organ of the invention, since this organ lacks a balance. According to the invention, the regulator organ is thus sized by integrating into the equation 1) here above a moment of inertia I calculated taking into account elements that are traditionally neglected in the prior art, notably by integrating into the calculation of the moment of inertia I the moments of inertia of the staff 2, of the roller 4, of the hub 3 and of the spiral 1 itself, which yields an approximation for the oscillation frequency.

The moment of inertia of the spiral 1 varies however during each cycle when the spiral deforms, so that applying the above formula yields only an approximation. In practice, a regulator organ oscillating at the desired frequency is achieved using the formula 1) here above, I being approximated by adding the inertia mass of all the rotating parts. An adjustment is then achieved by successive approximations by modifying the length of the portion of the spiral 1 that can vibrate using a cock, a regulator with a screw on top, or another regulating element, not represented.

Prototypes have been made with regulator organs capable of performing 500 beats per second, which makes it possible to measure durations timed with a resolution of the thousandth of a second. It is thus possible to make a mechanical chronometer at 500 Hz or to the thousandth of a second.

Figure 5:
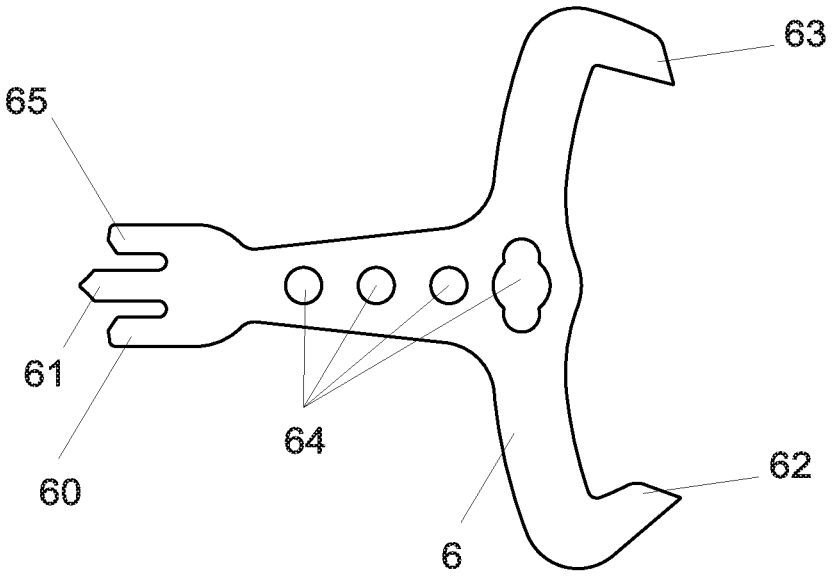
FIG. 5 illustrates a top view of a pallet that is part of the mechanical chronograph movement according to the invention.
Figure 6:
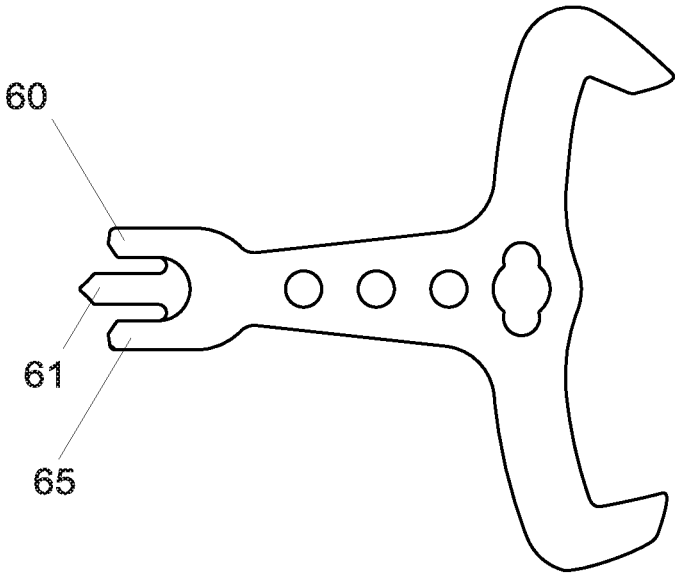
FIG. 6 illustrates a bottom view of the pallet of FIG. 5.

FIGS. 5 and 6 illustrate an embodiment of an escapement pallet 6 that can be used with such a regulator organ. By comparison with a conventional regulator organ, the inventive regulator organ is characterized by speeds of rotation of the axis that are considerably greater, for example 125 times greater. The impulsion supplied by the tooth of the pallet wheel (not represented) to the pallet 6 is thus clearly shorter whilst the transmitted energy is conversely greater. The result is a much greater acceleration of the pallet 6: each time the pallet wheel transmits an impulsion to it, the pallet topples nearly instantaneously (in less than a thousandth of a second) between one position and the opposite position. The rotation speed of the teeth of the pallet wheel is such that the pallet-tones can be removed and these teeth rest directly on the incoming and outgoing arms of the pallet by projecting the incoming and outgoing arms of the pallet at a distance as soon as they hit them; the arms do not have time to slide on the teeth of the pallet wheel. In other words, the impulse response of the pallet is much quicker than that of known ones and is of annular type.

Consequently, according to an independent characteristic of the invention, and as illustrated in FIGS. 5 and 6, the pallet-stones are absent and an annular contact, i.e. a punctual contact on a stopper or distributed according to a set of coplanar points and whose contact normals concur, occurs directly between the teeth of the pallet wheel and the arms 62, 63 of the pallet. The contact length between the pallet and the pallet wheel is advantageously lower than a tenth of millimeter, instead of a millimeter as in the state of the art. Advantageously, the extremity of these arms has a rounded shape, for example spherical or spiral or involute, with this shape being finely adjustable according to the frequency of the spiral. In one embodiment, the teeth on the pallet wheel advantageously have a complementary involute shape that allows it to adapt better to high frequency and ensure a perfectly punctual contact. These shapes of pallet arms are advantageous to ensure a quick and punctual contact between the pallet and the pallet wheel, without bouncing and nearly without sliding, even if, for example following an impact, the pallet and the pallet wheel do not find themselves in exactly the correct position during impulsion. The arms can be provided with a coating, for example a DLC (Diamond-Like Carbon) coating, to improve their resistance to impacts and reduce even further the residual friction (if it exists at all) between the arms and the pallet wheel.

In order to be able to move quickly, the pallet 6 is preferably made of a material lighter than steel, for example silicon. Through holes 64 allow it to be made even lighter. The guard pin 61 is constituted by a bridge joining the two horns 60 and 65 but less thick than these horns and than the rest of the pallet. The extremity of the guard pin 61 opposite the center of the pallet is pointed in order to work together with the impulse pin 40.

The regulator organ illustrated in the figures is advantageously used as independent regulator organ for a chronograph, in order to regulate the running of a chronograph hand at the center of the movement. For example, this regulator organ can drive a hand at the centre of the dial displaying the thousandths of a second of a duration measured by a stopwatch, and which runs through 100 graduations on the periphery of the dial within a tenth of a second.

Figure 9:
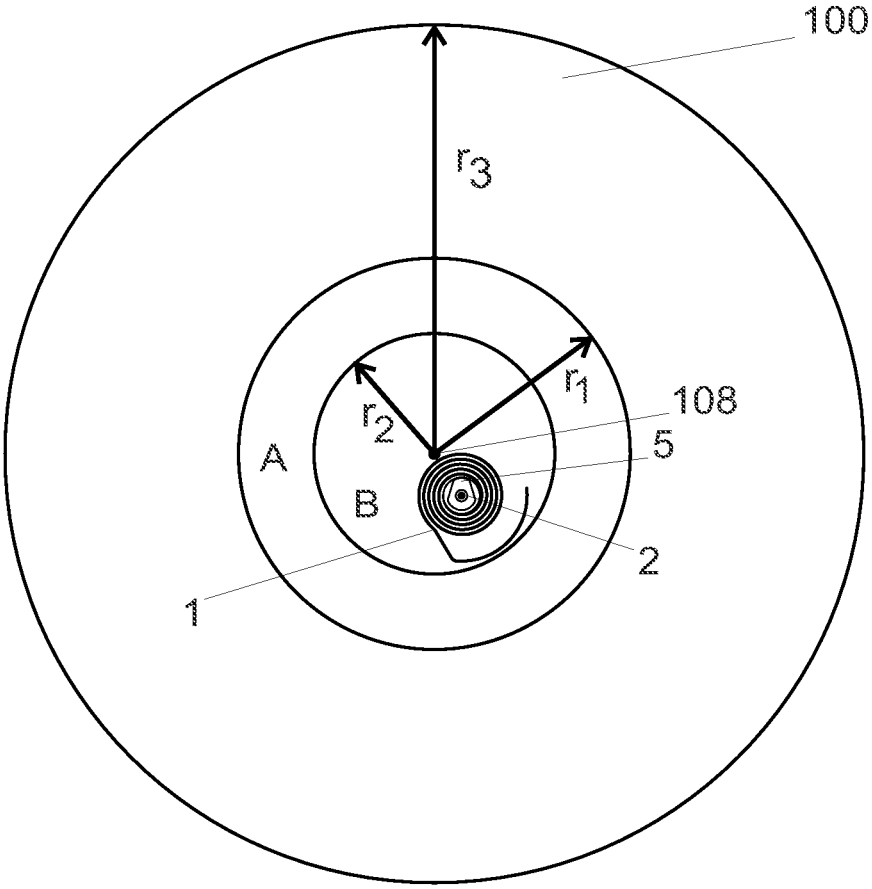
FIG. 9 illustrates the imaginary circles in which the regulator organ of the inventive movement can be placed.

In order to avoid any play and loss of energy, the regulator organ is preferably placed unusually very close to the center of the watch movement, which makes it possible to drive the hand at the center directly or at least through a gear chain as short as possible, for example a gear chain comprising a single wheel to invert the direction of rotation given by the pallet wheel. Preferably, the staff 2 of the spiral is located in an imaginary circle A coaxial to the movement and having a radius $r_1$ lower than 50% of the maximum outer radius $r_3$ of the movement, as illustrated in FIG. 9. Preferably, the staff 2 of the spiral is located in an imaginary circle B coaxial to the movement and having a radius $r_2$ lower than 30% of the maximum outer radius $r_3$ of the movement, thus very close to the center of the movement. In a preferred embodiment, it is located at the center 108 of the movement.

The regulator organ of the chronograph is generally placed closer to the center 108 than the regulator organ for regulating the running of the watch.

In a variant embodiment, the pallet wheel 8 is arranged to directly drive the hand at the center 108 of the dial. In another embodiment, the pallet wheel 8 is arranged to drive the hand at the center through a gear chain comprising a single mobile for inverting the direction of rotation given by this pallet wheel 8.

The chronograph hand, for example the hundredth or thousandth of a second's hand, thus accelerated can deform in the manner of a fishing rod during accelerations, which compromises the reading during displacement. In order to limit the extent of these deformations, the hand is advantageously ribbed and/or profiled to make it more rigid. The hand can also be replaced by a disc.

Figure 4:
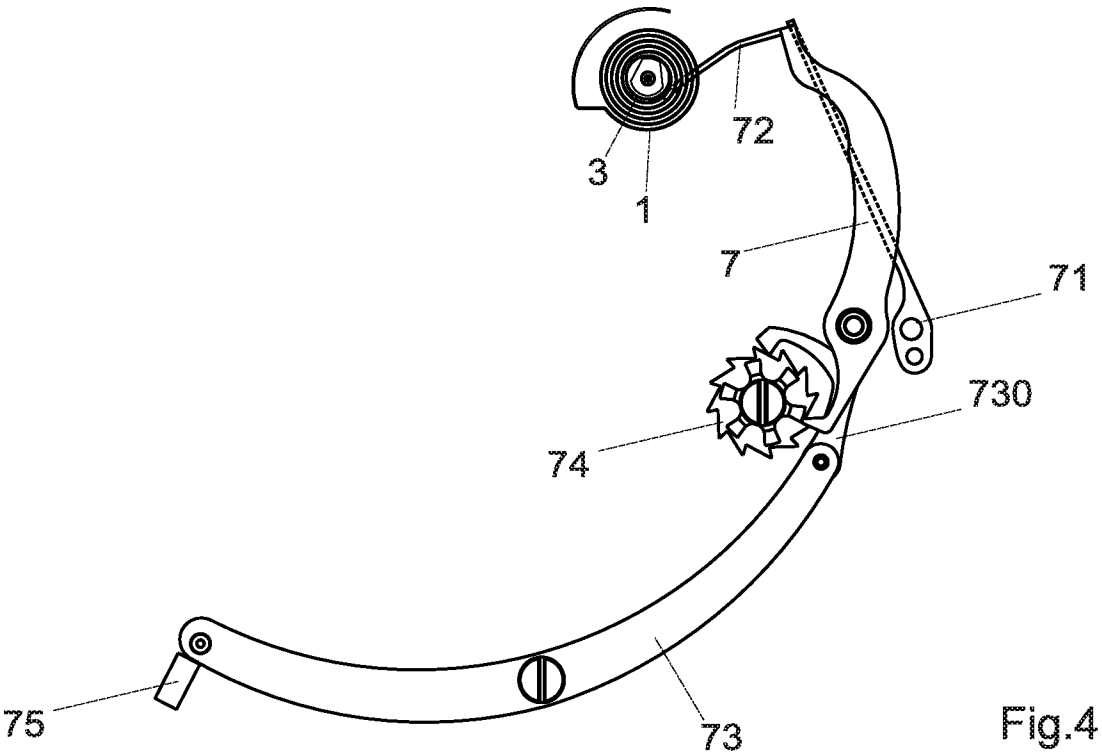
FIG. 4 illustrates a launcher that is part of the mechanical chronograph movement according to the invention.

FIG. 4 illustrates the launcher mechanism that allows the regulator organ of the chronograph to be started when the user presses on the push-button 75 and this regulator organ to be locked when stopped. In the case of a regulator organ according to the invention, the launcher comprises a flexible whip 72 that rests directly on the hub 3. In a variant embodiment comprising a balance, this launcher mechanism can comprise a whip 72 resting against the balance. The whip can comprise one or several parts and is more flexible than the rest of the launcher, in order precisely to whip the hub and start it instantaneously. The pressure of the push-button 75 is transmitted by the blade 73 to the column wheel 74 that suddenly frees the launcher 7 which is actuated by the launcher spring 71. The energy of this spring 71 is transmitted to the whip 72 that imparts a force to the hub 3 having a considerable tangential component, so as to accelerate suddenly the hub or the balance and the spiral staff, which makes it possible to launch the oscillator nearly instantaneously. While resting, when the user has pressed on the push-button 75 or on an additional STOP push-button, not represented, the whip 72 presses on the hub 3 by exerting a considerable radial force, in the position illustrated in FIG. 4, which blocks instantaneously and energetically the staff of the hub or of the balance.

The push-button 75, in a preferred embodiment, allows the user to implement the two functions START and STOP. Another push-button, not represented, allows a re-setting to zero.

When the user actuates the function STOP, it allows the launcher to climb on one of the columns of the column wheel 74. When the function STOP is actuated, the launcher spring 71 allows the launcher 7 to fall in the space between two columns of the column wheel 74 and simultaneously to give the whip 72 a speed that enables the hub or the barrel to be accelerated.

Advantageously, the blade 73 comprises a hook 730 that is designed to work together with the column wheel 74. In a variant embodiment, the blade and the hook constitute a single part that is rather difficult to manufacture but allows a reduction of the number of parts. In another variant embodiment, the hook 730 is a part distinct from the blade 73 and connected to it for example through a screw, which makes manufacture easier.

Figure 7:
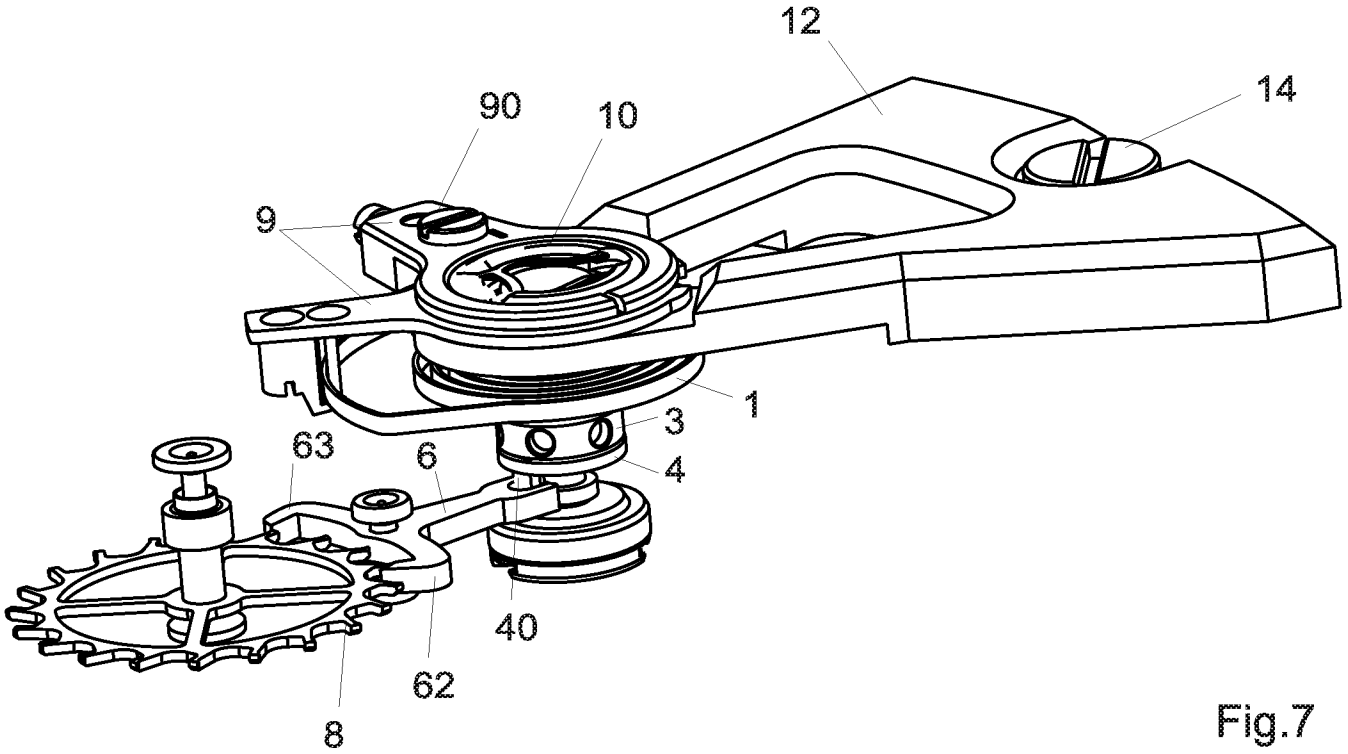
FIG. 7 illustrates a three-dimensional view of the regulator organ according to the invention, of the spring, of the pallet and of the pallet wheel that are part of the mechanical chronograph movement according to the invention.

FIG. 7 illustrates a three-dimensional view of the regulator organ according to the invention, of the spring 1, of the pallet 6 and of the pallet wheel 8. The regulator 9 works together with the screw 90 finely regulating the length of the spring 1, with a tuning fork 10 as well as a bridge 12 that is connected to the movement plate through the screw 14.

Figure 8:
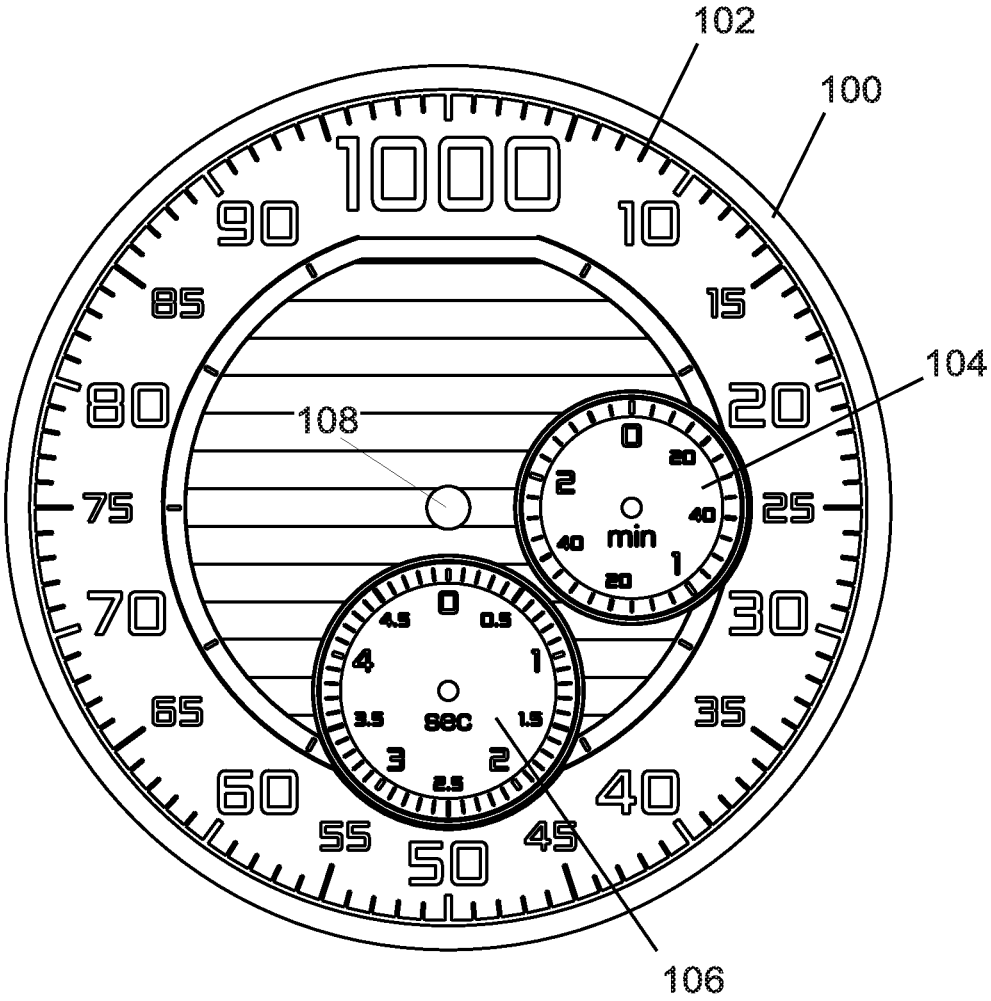
FIG. 8 illustrates a possible embodiment of the dial that is part of the mechanical chronograph movement according to the invention.

FIG. 8 illustrates a possible embodiment of the dial 100 that is part of the mechanical chronograph according to the invention. Advantageously, the dial 100 comprises a scale 102 with hundred graduations to indicate by means of a hand the thousandths of a second of the measured duration. In a preferred embodiment, the scale 102 is placed around the edge of the dial 100, since advantageously the thousandth of a second hand is placed at the center 108 of the dial 100. The scale 100 also enables the hundredth of a second to be measured, since $1/100^{th}$ of a second corresponds to $10/1000^{th}$ of a second.

In the variant embodiment illustrated, the dial 100 comprises two other small dials or displays: the dial 104 counting the minutes, preferably placed at 3 o'clock, and the dial 106 counting the seconds and the tenths of a second, preferably placed at 6 o'clock. In another variant, not illustrated, the dial comprises three small dials: a dial for counting minutes, preferably placed at 12 o'clock, a dial for counting seconds, preferably placed at 3 o'clock and a third dial for counting the tenths of a second, preferably placed at 6 o'clock. Any other arrangement of these small dials or displays is at all possible.

In another variant embodiment, the dial 100 comprises only a small dial for the tenths of a second, preferably placed at 6 o'clock. The dial for counting the seconds and the minutes in this case has its center corresponding to the center 108 of the dial 100 and has a radius lower than the radius of the dial 100. There will therefore be two concentric scales, one of the thousandths and the hundredths of a second (scale 102) and the other for the measured minutes and the seconds.

As discussed, the power reserve of the second barrel, which indicates the duration that can still be measured before the second barrel needs to be recharged, is preferably indicated on the dial 100 by means of a power reserve indicator of the chronograph, not illustrated. The power reserve of the first barrel charging the first regulator organ used for displaying the current time is advantageously indicated separately on the dial by means of a power reserve indicator of the watch, not illustrated.

The hands for the hours, minutes and possibly seconds of the watch are placed at the center 108 of the dial. A display of the small seconds can also be provided on the dial 100 as well as an indication of the date or of other information.

The regulator organ of the invention is also distinguished from the prior art regulator organs by the noise produced, which is different from the noise of the watch; by reason of the higher oscillation frequency, the usual tic-tac is replaced by a high frequency buzzing, with a main harmonic at 500 Hz and secondary harmonics at multiples of 500 Hz. This very characteristic and very perceptible buzzing allows the user to detect by ear that the chronograph is working and thus avoid an undesirable discharging of the chronograph's barrel if the chronograph is started inadvertently or if one forgets to stop it. The distinct and characteristic noise of the regulator organ of the chronograph is thus used as a signal indicating that the chronograph is functioning. The watch case can advantageously comprise elements, for example vents or a resonating cage, in order to amplify this useful noise.

In another variant embodiment, the spiral of the regulator organ according to the invention is replaced by a magnetic recall organ.

Reference Numbers Used in the Figures

1 Spiral
10 Tuning fork
12 Bridge
14 Screws for fastening the bridge to the plate
2 Staff of the spiral
3 Hub
30 Hollow in the hub
4 Roller
40 Impulse pin
42 Great roller
43 Small roller
430 Notch of the small roller
45 Hour wheel
5 Collet
50 Notch of the collet
6 Pallet
60 Incoming horn
61 Guard pin
62 First arm of the pallet
63 Second arm of the pallet
64 Through holes through the pallet
65 Outgoing horn
7 Launcher
71 Launcher spring
72 Whip
73 Blade
730 Blade hook
74 Column wheel
75 Push-button
8 Pallet wheel
9 Regulator
90 Screw for finely regulating the length of the spiral
100 Dial
102 Scale of the dial 100
104 Dial for the minutes
106 Dial for the seconds
108 Center of the dial
A Imaginary circle of a radius less than 50% of the maximum outer radius of the movement
B Imaginary circle of a radius lower than 30% of the maximum outer radius of the movement
r1 Radius of the circle A
r2 Radius of the circle B

The invention claimed is:

1. Mechanical watch movement comprising;

a movement, wherein the movement has a center that defines an axis; and a mechanical chronograph including a regulator organ for regulating running of the chronograph, wherein said regulator organ of the chronograph is placed within an area defined by an imaginary circle wherein the imaginary circle is coaxial to the movement and has a radius smaller than 50% of a maximum outer radius of the movement.

2. Mechanical watch movement according to claim 1, wherein said imaginary circle coaxial to said movement has a radius smaller than 30% of the maximum outer radius of said movement.

3. Mechanical watch movement according to claim 1, wherein said regulator organ of the chronograph is placed at the center of the movement.

4. Mechanical watch movement according to claim 1, wherein said regulator organ of the chronograph is arranged to drive a hand at the center of the movement, the hand at the center is configured to indicate hundredths and/or thousandths of a second.

5. Mechanical watch movement according to claim 1, having an escapement with a pallet wheel arranged to drive directly a hand at the center of the movement.

6. Mechanical watch movement according to claim 5, wherein said pallet wheel is arranged for driving the hand at the center of the movement through a gear chain having a single mobile to invert a direction of rotation given by said pallet wheel.

7. Mechanical watch movement according to claim 1, further comprising a first regulator organ for regulating the running of the watch, with the regulator organ of the chronograph being placed closer to the center of the movement than the first regulator organ.

8. Mechanical chronograph including the movement according to claim 1.

9. Mechanical watch movement according to claim 1, wherein the regulator organ of the chronograph is configured to oscillate at a frequency greater than about 500 Hz.

10. A watch, the watch comprising:

a mechanical watch movement, wherein the movement defines an axis, said movement comprising:

a mechanical chronograph including a regulator organ for regulating running of the chronograph, wherein said regulator organ of the chronograph is located within an area defined by an imaginary circle, wherein the imaginary circle is coaxial to the axis of the movement and has a radius smaller than 50% of a maximum outer radius of the movement.

* * * * *